US005582309A

United States Patent [19]

Bruhn

[11] Patent Number: 5,582,309

[45] Date of Patent: Dec. 10, 1996

[54] MANUALLY REMOVABLE CROWN CAP

[75] Inventor: Esben Bruhn, Odder, Denmark

[73] Assignee: Ribi Invest ApS, Aarhus C., Denmark

[21] Appl. No.: 119,158

[22] PCT Filed: Mar. 18, 1992

[86] PCT No.: PCT/DK92/00085

§ 371 Date: Sep. 20, 1993

§ 102(e) Date: Sep. 20, 1993

[87] PCT Pub. No.: WO92/16426

PCT Pub. Date: Oct. 1, 1992

[30] Foreign Application Priority Data

Mar. 18, 1991 [DK] Denmark ..... 0475/91
Dec. 4, 1991 [DK] Denmark ..... 1955/91

[51] Int. Cl.[6] ..... B65D 39/00

[52] U.S. Cl. ..... 215/301; 215/305; 215/328

[58] Field of Search ..... 215/250, 253, 215/254, 301, 305, 324, 328

[56] References Cited

U.S. PATENT DOCUMENTS

| | | | |
|---|---|---|---|
| 1,605,708 | 11/1926 | Clark | 215/301 |
| 1,671,015 | 5/1928 | Deny | 215/301 |
| 1,715,882 | 6/1929 | Wygonik | 215/253 |
| 2,695,720 | 11/1954 | Faccou | 215/328 X |
| 3,269,577 | 8/1966 | Stuart | 215/254 |
| 3,382,997 | 5/1968 | Tsuji | 215/253 |
| 3,675,805 | 7/1972 | Shane | 215/253 |

FOREIGN PATENT DOCUMENTS

| | | | |
|---|---|---|---|
| 235054 | 3/1960 | Australia | 215/253 |
| 604002 | 4/1960 | Italy | 215/253 |

*Primary Examiner*—Stephen K. Cronin
*Attorney, Agent, or Firm*—Antonelli, Terry, Stout & Kraus

[57] ABSTRACT

A bottle closing cap is disclosed that is openable merely by a finger pressure on a domed top side of the cap, whereby it is possible to provoke an expansion of a depending, axially preslit cap skirt portion of the cap. The cap can resist overpressure in the bottle because the ends of the skirt segments are stabilized against overlapping, e.g. in that at each slit (6) they are shaped with respective counterphased edges (12,14). Hereby the caps will be mountable by a fully conventional equipment and, despite being easy to open, they will resist a considerable pressure in the bottles.

9 Claims, 4 Drawing Sheets

MANUALLY REMOVABLE CROWN CAP

FIELD OF THE INVENTION

The present invention relates to a closing cap, preferably a bottle closing cap of the Crown-Cork type. These caps have already proven their good qualities with regards to cheapness, facility of handling, closing efficiency and reasonable facility of opening, and it is a well-established practice that special opening means are used for opening the caps, which means in the shape of special cap openers are a permanent part of kitchen equipment and even to a great extension of personal equipment similarly to combs, cigarette, etc. It is fully acceptable that opening the cap closed bottles by means of cap openers requires a certain force.

BACKGROUND OF THE INVENTION

However, it has previously been realized that another, simpler method of opening the caps is possible, viz. by a downwards finger pressure against the central area of the cap. This method of opening can be used when the cap is previously prepared in the simple manner that the downwardly projecting cap skirt is provided with three or more slits placed along the circumference of the cap. The skirt portions which cooperate with the bottle head will hereby appear as segments of e.g. 120° or 90°, and if the top surface of the cap is just slightly domed, it will be obtained through the downward pressure on the central area of the cap that the individual segments are swung outwards from their engagement with the bottle neck, such that the cap is loosened from the bottle with no need for a usual cap opener.

This would be a particularly attractive opening method, but it has been observed that the slits of the cap skirt diminish the ability of the cap to resist a positive pressure in the bottle to such an extent that this technique has not been usable in practice. Most bottled products are subject to a considerable positive pressure in the production phase, and the caps should also be able to resist such positive pressure in the bottles which may occur later on, e.g. by climatic heat.

SUMMARY OF INVENTION

It is the purpose of the invention to provide a cap closure which may be opened in the said simple manner by depressing a central portion of the cap, and which may however resist such a considerable pressure in the bottle that the cap closure will be usable in practice.

The invention is based on the consideration that the curved cap skirt segments actually should be able to secure the cap despite a great inner pressure in the bottle, if the segments are in the same firm holding engagement with the bottle as the usual, unbroken cap skirts, as the round segments are still in a strong holding engagement with the upper portion of the cap. Thorough examinations have shown that the cause of the weakened holding engagement is not the segmentation as such, but rather the fact that by the mounting of the capsule and the subsequent radial constriction of its skirt for establishing the holding engagement with the bottle neck, the individual segments are not compressed peripherally sufficiently for the undulated engagement portions of the cap skirt to assume a fully efficient holding engagement with the expansion on the bottle neck. The cause hereof is that the segments, at their free end flanges facing each other, are brought to overlap slightly when the cap skirt is effected to constrict about the bottle neck.

By the invention it is an aim to achieve such a strong closing of the segmented cap that the closing is efficient in connection with such high inner pressure in the bottles that it is usable in practice in connection with bottles with positive pressure, e.g. beer bottles. According to the invention this may be realized by shaping the cap members in such a manner that the material right next to the segmenting slits is embossed to form a serrated or undulated course of the associated slit edges, such that associated, opposing slit edges are undulated in mutual counter-phase. Even though the material is thin it will hereby be obtained that the two edges of material at each slit may be pressed very strongly against each other-without overlapping. The cap may therefore be closed in an entirely normal manner by radial compression of the skirt while obtaining that each segment remains at its square, e.g. 120°, during the radial compression; this means that by the downwards and inwards bending they are forced to undergo a peripheral constriction as strong as by non-segmented caps, and this constriction is essential for the skirt undulations of the cap to be deformed further inwards against the bottle neck, thus assuming a strong holding engagement with the downwardly oriented holder surface of the bottle head.

Even though the said observed overlapping of material at the slits is very small, it seems to be important enough to be responsible for a weakened closing effect, as it occurs that a far stronger closing is obtainable solely by providing that the slit edges, e.g. in the said manner, are prevented from sliding over each other, with no further modifications whatsoever being necessary for the preparation and the application of the caps.

However, the invention also comprises another and at least as important embodiment for achieving the desired result, viz. an embodiment in which the cap skirt is slit from the lower edge along only a partial section of the skirt height up to a point near the upper end of the skirt. When unslit material is left at this upper edge, this may be sufficient for ensuring that the slit edges are stabilized against travelling over each other when the skirt is folded down. There remains only the problem that the thereby continuous upper end portion of the cap skirt will generally counteract an expansion of the skirt segments by depression of the central area of the upper surface of the cap, but this problem may be overcome by a further slit being provided immediately next to each skirt slit and extending over the folding area of the skirt, and from here both somewhat downwardly along the skirt, however without reaching the lower edge hereof, and somewhat inwardly along the top surface of the cap, however without reaching the centre thereof.

Hereby the cap will be mounted in a fully stable manner, because the free edges of the cap skirt segments will be permanently abutting and not overlapping, while the added slits across the folding area will have no particular effect by the downwards and inwards folding of the cap skirt.

When the central area of the cap is depressed for opening the cap, an outwards turning of the skirt segments will be provoked as mentioned above, but now this turning will be diminished by the continuity of the skirt at the top of the downwardly open slits. However, the added slits across the folding area will compensate for this fact, entailing the circular folding area to be expandable in the peripheral direction when the area is provoked to effect such an expansion, by the occurrence of an opening or expansion of these transverse slits. This expansion is transmitted to the cap skirt as a whole, which is thereby further caused to release the locking engagement with the bottle neck. In their normal state, the transverse slits will not diminish the closing effect of the cap, as they are all but caused to contract or close by the inner pressure of the bottle, which attempts to press the cap dome upwards and thereby causes the cap periphery to contract.

BRIEF DESCRIPTION OF DRAWINGS

In the following the invention is described in more detail with reference to the drawing, in which.

DETAILED DESCRIPTION OF DISCLOSED EMBODIMENTS

Figure 1:
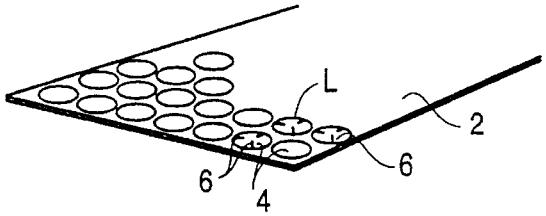
FIG. 1 is a perspective view of a plate member for punching out cap members.
Figure 2A:
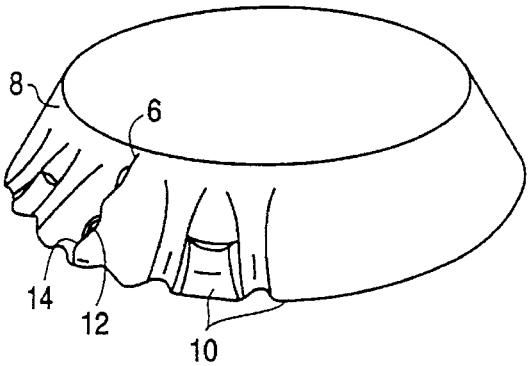
FIG. 2A is a perspective view of a cap member.

In FIG. 1 is shown a metal plate member 2 from which a number of cap members, marked by circular fields 4, are to be punched out in a conventional manner. In connection with or preferably prior to this punching, which is not illustrated in more detail, three outer radial slits 6 are provided in each cap member and extend over the subsequently shaped skirt area of the caps with a mutual separation of 120°. In connection with the punching of the circular members 4, these are processed in a conventional manner by deformation pressing where the outer skirt portions of the caps, designated by 8 in FIG. 2*a*, are pressed down to a protruding inclined position and provided with those skirt undulations 10 which are a characteristic of Crown-Cork caps. The pressing tools of the pressing apparatus may be modified in such a manner as to shape the opposing slit edges 12 and 14 by each slit with an undulated mutually counterphased course in the immediate proximity of the slits 6, such that these edges, as shown in FIG. 2A, will intersect at several points. It should be mentioned, however, that these undulations are preferably embodied in direct integration with the shaping of the slits 6, viz. by suitable shaping of cutting tools at opposing sides of the members.

Figure 3:
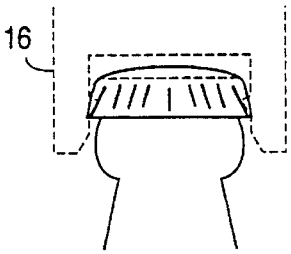
FIG. 3 is a side view of a bottle neck with applied cap.

Later when the cap member is placed on and fixed onto a bottle, this takes place as shown in FIG. 3 by a tool 16 being pressed down over the top of the bottle and forcing the skirt 8 to be folded inwards and downwards in a fully conventional manner, whereby the lower portions of the skirt undulations 10 are caused to engage below an upper expansion on the bottle top for tight sealing thereof.

The application of the tool 16 will entail both the said downwards and inwards folding of the skirt 8 and an associated peripheral compression of the skirt, whereby the skirt undulations 10 are deformed for further engagement against the upper holder expansions of the bottle neck, producing an enforced engagement against this. This latter contribution is weakened if the abutting ends of the segments are allowed to slide slightly over each other in the peripheral direction regardless of the radial impression from the tool 16 being of the same importance all the way round. Such sliding will not occur by the invention, as the counterphased undulations prevent the edges 12 and 14 from passing each other, the result being that the cap is applied and deformed for sealing in the very same manner as if it were a usual cap without slits 6.

As a practical illustration of the state of things it may be mentioned that by testing it has been observed that caps with non-undulated slits 6 after application have been able to resist bottle pressure of about 3 bar, whereas by quite the same type of application, quite similar caps provided with counterphased undulated slits have been able to resist a pressure of 8–9 bar or more, which is acceptable in connection with bottled drinks containing carbon dioxide.

During the clamping of the caps by the tool 16, the undulated configuration of the slit edges 12 and 14 will be smoothened to some extent, but the smoothing will be progressive in such a manner that a secure mutual abutment of the edges will be permanently maintained. Even if a total smoothing of the undulations occurs towards the end of the deformation process, this will happen at such an advanced point of time where both the radial and peripheral constriction have taken place, such that it makes no significant difference whether the slits are subject to an almost microscopic deplacement over each other in the very last processing phase, and anyway no such tendency is observed. The smoothing in question has the advantageous effect that the extreme and maybe noticably protruding sharp corners at some of the segment ends are pressed to a position in which they present no tearing danger.

The caps are shaped with a slightly domed top side, and after application they may then be opened merely by a downwards pressure against the central top side area, the cap skirt segments hereby being caused to swing outwards and thereby to release the holding engagement with the bottle neck. The caps may perfectly well be adapted to being applicated so as to resist a great pressure in the bottles and still be openable already by a suitably strong downwards finger pressure against the central cap lid portion. It must be considered in this connection that the great pressure which the caps must be able to resist does not necessarily occur in the situation where the bottles are opened.

By the embossing, the cap members should be provided with a noticeably domed top side, viz. such that this top side, which will be considerably straightened during application and fixing of the caps as a consequence of the downwards folding and pulling of the skirt portion, will still be sufficiently domed thereafter for being depressible for opening of the cap.

In FIG. 2D it is shown that the slits 6' may be shaped in such a manner that a mutual holding engagement will occur between the abutting segment edges to counter pull effects in the peripheral direction of the skirt, which may be significant for preventing the occurrence of a slight radial expansion of the downwardly and inwardly folded cap skirt after removal of the application tool 16, which could weaken the holding effect of the cap. There will then merely occur the associated problem that attempts to open the cap by depressing its central portion will not provoke the aimed outwards swinging of the skirt segments, when these are maintained end flange by end flange also during the outwards swinging actuation of the segments.

Figure 2B:
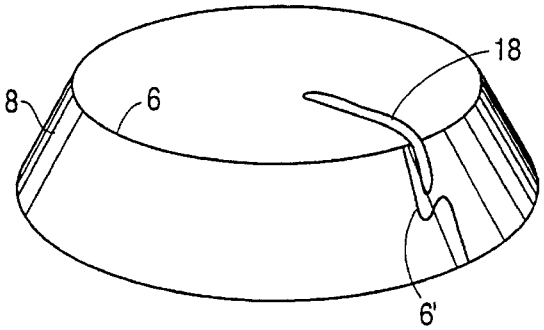
FIG. 2B is a perspective view of a cap member like that in FIG. 2A except that the slits have a mutual holding engagement and a radial rib is formed thereon.

However, according to the invention it will yet be possible to achieve a well controlled opening of the cap, when, as shown in FIG. 2B, this is provided with a formed radial rib 18, extending along the top side of the cap and somewhat down the skirt near one side of the slit 6'. When each slit is provided with such a rib at one side, but not at the other, a pressure on the cap top will entail a stronger outwards swinging actuation of the cap skirt at that side of the slits which is provided with ribs, and hereby the said engagement will be sufficiently released for a subsequent release of the segment ends from each other and a further outwards swinging for releasing the cap. By this embodiment there should not occur too pronounced undulations along the slit edges, as the engagement may then be difficult to release.

The invention comprises furthermore another cap type, where the skirt is only provided with two opposed slits, i.e. with two segments each of 180°. Hereby each segment is in a quite strong holding engagement with the bottle neck, and such a cap cannot be opened just by a pressure on the top side. However, the cap becomes very easy to open by means of a regular cap opener; so easy that it proves possible to open a fully closed cap by means of a short 'jimmy'in the shape of a web portion protruding from the cap itself and shaped as an integrate part thereof. This is illustrated by a couple of examples, cf. FIGS. 4 and 5.

Figure 4:
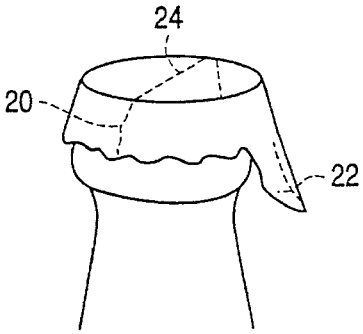
FIG. 4 is a perspective view of a modified embodiment of a cap.

The cap shown in FIG. 4 has its skirt provided with two diametrically situated slits 20, and one of the skirt segments thus produced is provided at its centre with a protruding web which is bent down together with the skirt in the mounted condition of the cap, and thereby forms an arched opening handle 22, which may be immediately gripped by a finger and tipped outwards and upwards, whereby the cap is folded along the line 24 shown in dots, such that it is easy to remove thereafter. Because of the arched cross sectional shape the web 22 is sufficiently rigid for transmitting the necessary force, even if it made from the same, relatively thin plate material as the cap itself. It may be preferred in practice that such an opening handle 22 be provided on both opposed segments.

Figure 5:
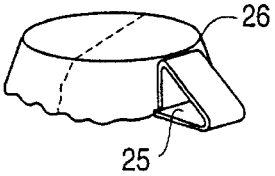
FIG. 5 is a corresponding representation of another such cap.

FIG. 5 shows another embodiment, where the web is shaped as a protruding strip element 25 which may be bent or is bent in order to form a sort of jimmy supported against the upper side area of the cap skirt and being grippable by a finger. Because of the upper abutment as shown at 26 a rather well controlled opening sequence is obtained.

Figure 6:
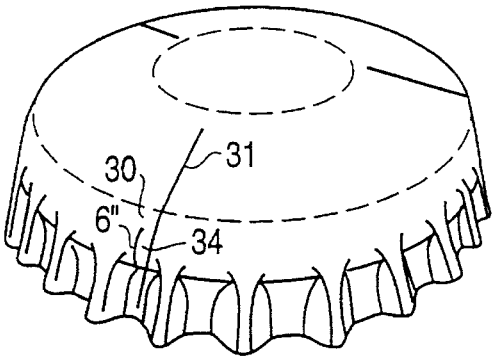
FIG. 6 is a perspective view of a preferred embodiment of a cap member, modified relative FIGS. 1–3, FIG. 7 the same, shown in opened condition.

The cap member shown in FIG. 6 is a more ordinary member, which, similarly to the embodiment according to FIGS. 1–3 is well suited for being produced and used as a usual Crown-Cork cap, only with the option of being opened by depression. It has shown that the embodiment according to FIGS. 1–3 may present difficulties as to a permanent sealing of the bottle closing at a high inner bottle pressure, regardless of the sealing effect being considerably better than with the previously known embodiments of manually openable caps. The cause hereof seems to be that the slits 6, see FIG. 2A, extend entirely up to the folding area of the caps, whereby the skirt lacks a bit of stabilization against expansion at an occurring upwardly directed pressure on the cap.

By the embodiment according to FIG. 6 this is improved by the slit not quite reaching the folding area; an upper skirt portion 30 is left continuous. This has been proven sufficient for the two edges of the slit being stabilized in such a manner that by the common downwards folding they remain right opposite from each other, i.e. without overlapping, and it is therefore less necessary to produce those edge undulations that are disclosed in connection with FIGS. 2A and 2B, even though these undulated edges will still be preferred. Furthermore, the continuous portion 30 stabilizes against an outwards swinging of the skirt segments subsequently to an upwards pressure against the cap surface from inside the bottle, i.e. the cap closes quite strongly.

The cap is indeed correspondingly more difficult to open by pressure from above, but this may be countered by adding the shown additional slits 32, preferably immediately next to the slits 6'. These slits 32 extend across the folding area of the of the skirt and therefrom downwards to a certain distance above the lower edge of the skirt as well as a certain distance inwards, e.g. half way to the centre of the cap plate member. It is important that these slits do not perforate the bottom of the skirt, as the said stabilizing effect on the skirt segments would then be lost. The segmentation which occurs by adding the slits 32 will not weaken the cap as to its holding effect against the inner bottle pressure, as the skirt segments do not become substantially easier to swing out by this addition, but the added slits will facilitate the manual opening of the cap considerably. As the cap surface is domed, the inner pressure will effect a contraction of the roundgoing folding area of the cap which cannot take place, but by a downwards operation pressure the same area will be brought to expand, whereby the slits 32 open slightly, as shown exaggeratedly at 33 in FIG. 7.

Simultaneously, the skirt segments will be caused to swing out, whereby also the slits 6' open, however less that by the embodiment according to FIGS. 1–3; however, the opening of the slits 32 will contribute noticeably to an outwards sliding of the skirt segments and thereby to a release hereof from their engagement with the bottle, such that despite the improved holding effect, the cap is still suitably easy to open in the disclosed manner.

The strip-shaped skirt portion 34 between the different pairs of slits 6' and 32 will twist slightly by the opening, and it would seem that it is a condition for the good openability that these strip portions be sufficiently narrow to be affected to perform such a twisting which furthers the opening of both types of slits 6' and 32.

Figure 7:
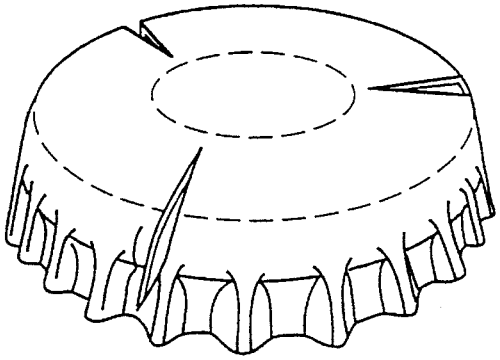

Also by the embodiment according to FIG. 6 and 7 there may—as in FIG. 2B—advantageously be provided rib formations 18 for enforcing the tipping action on the skirt segments by the pressing opening of the cap. It is enough to mention here that these ribs may have many different configurations, and that the invention is not limited to any defined configuration of the ribs; they may be more or less evenly distributed, e.g. gathered in groups facing the individual segments.

Figure 8:
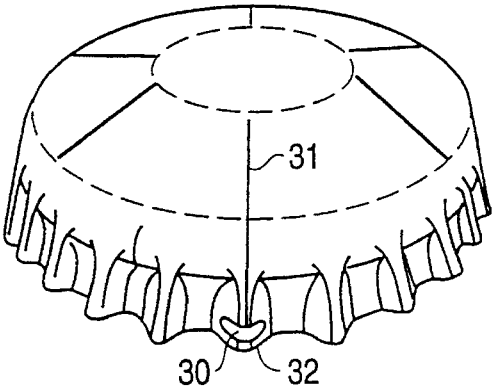
FIG. 8 is a representation of a further embodiment of a cap according to the invention, FIG. 9 the same, shown in opened condition.

In FIG. 8 is shown a modified embodiment of the cap, where the slits 6 or 31 are embodied in such a manner that they extend almost out to or down to the free end of the cap skirt, but exactly without perforating the outermost edge portion. At the outer slit ends in question a transverse slit is added, possibly in the shape of a punched hole 30, whereby a narrow, continuous strip portion 32 is formed in the undulated lower edge course of the skirt across the outer end of the slit 6. The presence of this continuous strip portion may be sufficient to ensure that the opposed skirt edges at the slit 6 cannot be pressed past each other by the constriction of the cap skirt about the bottle neck, such that the said undulations will be omittable.

Figure 9:
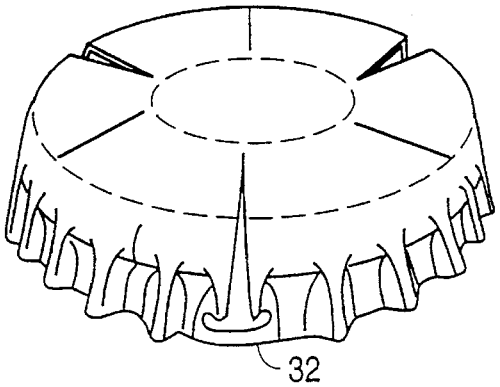

Ideally the width of the strip portion 32 should be so small that this portion is broken when the centre of the cap is depressed, but this is difficult to obtain in a well controlled manner, nor is it necessary, as the expansion force which will be transmitted to the skirt by this depression will serve instead for straightening the undulated portion, which the strip portion 32 is following, whereby it is possible nevertheless to obtain the skirt expansion that conditions a release of the cap, such as it is shown in FIG. 9.

Figure 10:
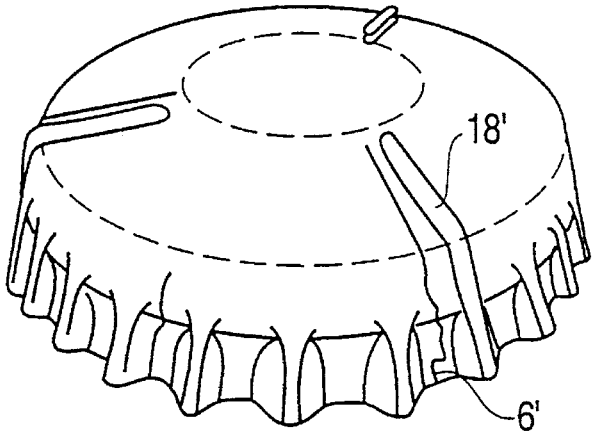
FIGS. 10 and 11 are perspective views of a modified cap according to the invention.
Figure 11:
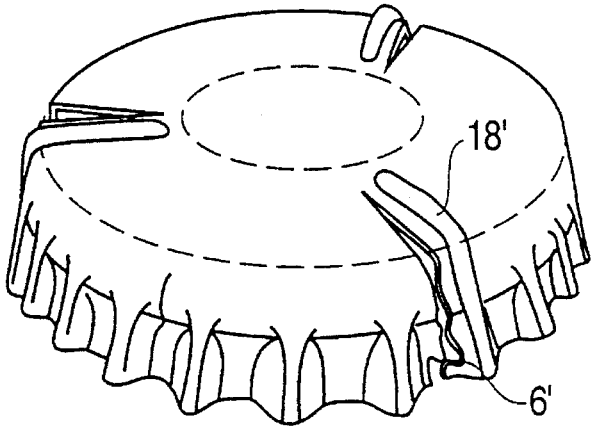

FIGS. 10 and 11 show, in respective closed and opened positions, a modified cap having slots 6' and ribs 18' as in FIG. 2B, only with the slots extended inwardly over the cap and the ribs 18' extended down to the edge of the cap As far as the punching of the slits is concerned, these may as suggested be shaped simultaneously to the punching of the cap members 4, but for several reasons it is preferred to shape them during a separate operation prior to this punching. This entails that the punching apparatus may be used without changing, whereby the entire production and application line may be used without change, only with the modification that a special slit cutter unit is inserted before the punching machine. The thin plate members with the preprinted cap areas may then alternatively be conveyed directly to the punching machine, when a series of conventional caps is to be produced.

The shaping of the dome on the cap top surface and/or the disclosed radial rib portions may in the same connection take place in the slitting unit, but with a rather important production it is probably best to effectuate also this embossing in the embossing and punching machine. It could even be tolerated that Crown-Cork caps in general be provided with the dome that is desired, when the members are furtherly processed accordingly to the invention.

In FIG. 1 the letter L suggests that cutting lines 6, which perforate the edge of the cap members 4, may be provided advantageously with an angled end portion, as the cutting line itself may then be provided by punching up a triangular web, which may later be pressed back to plane. In this manner the cutting lines may be produced without any strains occurring in the material.

Figure 12:
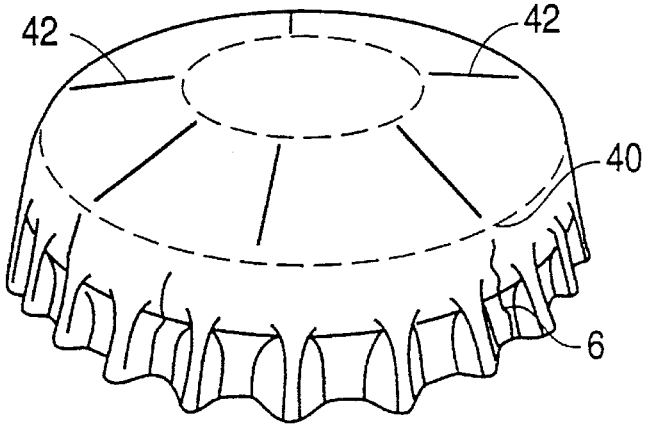
FIG. 12 is a perspective view of a further modified cap according to the invention.

By the embodiment shown in FIG. 12 slits 6 are used which project inwards over part of the top surface of the cap, but have a short interruption 40 precisely in the upper rim line of the cap, such that the cap goes round uninterrupted along this line. The rim area attempts to expand when the domed cap top surface is depressed, and the areas 40 may ideally be arranged so as to break when thus actuated, which, however, requires an extremely accurate working if the cap also has to keep its tightly sealing shape. It is indicated that between the slits 6 further slits 42 are provided in the cap top surface near the rim hereof; these slits will contribute to facilitate the expansion of the rim area, and optionally they may even extend out over the rim area.

Figure 13:
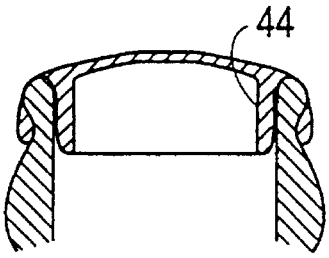
FIGS. 13–15 are sectional views of caps mounted on bottle necks.
Figure 14:
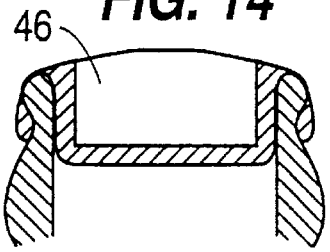
Figure 15:
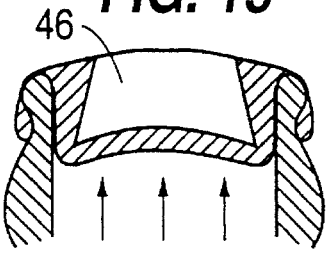

Slits occurring in the cap top surface will of course imply that a cover layer be found at the underside of the caps so as to seal the slits until the cap is opened. In this same connection it may be important that this sealing layer, which is already known as a gasket layer for sealing against the top surface of the bottle neck, be embodied in an additionally sealing manner, viz. by being provided, as shown in FIG. 13, with a cylinder portion 44 projecting down into the bottle neck and being pressed out against the inner side of the bottle neck area by the inner bottle pressure so as to obtain the desired additional sealing. Alternatively an insertion member 46 may be used as shown in FIGS. 14 and 15 with and without inner pressure in the bottle, respectively.

By the invention it is of great importance that usual machinery can be used for mounting the caps. It should be noted, however, that with certain cap qualities the disadvantage may occur that by the downwards actuation of the skirt for folding it in, an extrusion of material from the lid plate member may occur, when this plate member is of the said domed shape. Hereby the lid plate member is more or less flattened out, such that it may possibly become too weak for effecting the press opening function.

Figure 16:
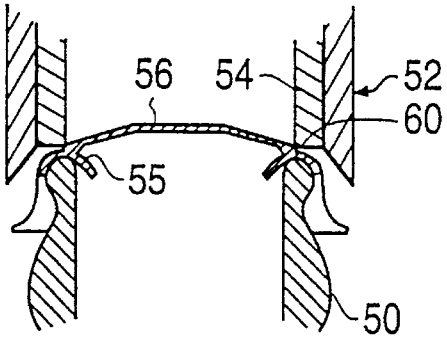
FIGS. 16–17 are sectional views for illustrating the mounting of a modified cap.
Figure 17:
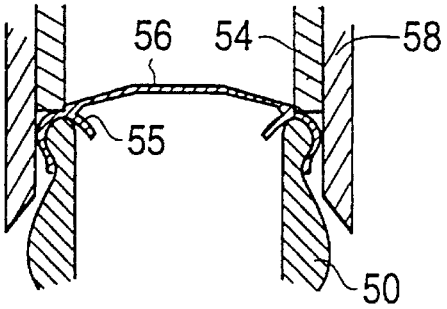

However, this difficulty may be overcome according to the invention with no required modification of the application tools, simply by an adapted embodiment of the caps members, which is illustrated in more detail in FIGS. 16–17. In these figures is shown a bottle neck 50 placed below a quite conventional closing tool 52 consisting of an inner tubular piston 54 which is downwardly projectable for fastening the rim of a cap member 56, loosely placed on the bottle opening, against the top edge of the bottle opening, and a surrounding tube piston 58, which may subsequently be projected down for pressing the cap skirt, cf. also FIG. 3. Regardless of the inner tube piston holding the cap firmly pressed against the bottle opening, the depression of the outer stamp 58 may provoke an extrusion of material from the top side of the cap, when this is domed, whereby the said undesired flattening may occur.

However, the cap member 56 is provided with an outer roundgoing depression 60 which exactly fits the inner edge position of the inner tube piston 54, whereby the said extrusion of material from thee top side of the cap 56 will be prevented such that the cap top may remain domed as desired.

The depression 60 may be produced in the same process as the punching of the cap members 4, cf. FIG. 1, i.e. by producing a suitable punching tool once and for all, such that the problem disclosed here may be prevented in a very simple and cheap manner.

I claim:

1. A closing cap for a bottle having an upper expansion about an opening to be closed by said cap, said closing cap comprising a cap plate member having an outer edge portion projecting downwards and shaped for engagement below said upper expansion member of said bottle, said cap having a skirt portion which is shaped with a segmenting axial slitting in at least two areas around its circumference wherein said slits in the cap skirt portion are shaped in such a manner that abutting end edges of adjacent segments of the skirt portion at each slit are stabilized against being displaceable to mutual overlapping by a skirt portion constriction which is provoked by the mounting of the cap on the bottle and wherein said abutting end edges of adjacent segments are provided with an undulated surface course, extending principally in counterphase with one another.

2. A closing cap according to claim 1, wherein an upper portion of said cap plate member is domed so that it can be depressed for expanding said skirt portion, and wherein the cap is provided with at least one pressed-up radial rib formation, which from the cap plate member extends out over the rim thereof and further down along the skirt portion at ane side, but not immediately at the other side of one of said slits.

3. A cap according to claim 1, wherein the slits in the skirt portion have their upper ends situated at a certain distance below the upper edge of the skirt portion, and said cap, in the immediate proximity of the slits, being provided with further slitting in the shape of cutting lines, which from an area of the cap plate member extend out over the rim of this plate member and further down on the skirt, however without completely reaching the lower edge thereof.

4. A cap according to claim 1, wherein at least one of the skirt segments at its bottom is extended to form a swingable opening handle for purely manual opening of the cap.

5. A cap according to claim 1, wherein the slits of the cap skirt portion are not continued completely down to the lower edge of the skirt portion, but only to an area very near this lower edge.

6. A cap according to claim 5, wherein at the lower end of the slits an opening is provided in the cap skirt portion, which opening extends in the horizontal direction across an undulated area of the skirt portion, such that by the opening action, the skirt portion may expand by a straightening of the continuous undulated strip area left at the lower edge of the cap.

7. A cap according to claim 1, further comprising an inner sealing gasket for abutting the bottle neck opening, said gasket, for relieving the inner pressure up against the manually openable cap, is formed as a bowl member projecting downwards into the bottle opening and the sides of which being pressed out against the inner side of a bottle neck of the bottle by the bottle pressure directed against the bottom of the bowl member.

8. A cap according to claim 1, wherein near the periphery of the cap plate member, the cap is provided with an annular outer depression, which makes it possible by the mounting of the cap for an adjacent tubular holder member to engage a vertical wall portion of this depression for fastening the on said bottle.

9. A cap according to claim 1, further comprising an inner sealing gasket for abutting a neck opening of the bottle, wherein said sealing gasket is provided with a sealing collar projecting into the neck opening of said bottle and being conically constricting in the downwards direction.

* * * * *